US012037179B2

(12) United States Patent
Marrow

(10) Patent No.: US 12,037,179 B2
(45) Date of Patent: Jul. 16, 2024

(54) NOTCHED CORNER POST FOR APPLIANCE PACKAGING

(71) Applicant: Sonoco Development, Inc., Hartsville, SC (US)

(72) Inventor: Matthew Wayne Marrow, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/964,428

(22) Filed: Oct. 12, 2022

(65) Prior Publication Data

US 2024/0124206 A1 Apr. 18, 2024

(51) Int. Cl.
*B65D 81/05* (2006.01)

(52) U.S. Cl.
CPC ..... *B65D 81/054* (2013.01)

(58) Field of Classification Search
CPC .. B65D 81/054; B65D 81/053; B65D 81/056; B65D 81/05; B65D 81/127; B65D 2581/053; B65D 5/5033
USPC ..... 206/586
See application file for complete search history.

(56) References Cited

U.S. PATENT DOCUMENTS

| | | | | |
|---|---|---|---|---|
| 4,050,604 | A | 9/1977 | Flanders | |
| 4,482,054 | A | 11/1984 | Gardner | |
| 4,483,444 | A | 11/1984 | Gardner | |
| 5,267,651 | A | 12/1993 | Hughes | |
| 5,593,039 | A | 1/1997 | Ortlieb | |
| 6,059,104 | A | 5/2000 | Widman | |
| 6,155,419 | A | 12/2000 | Sowa | |
| 6,186,329 | B1 | 2/2001 | Qiu | |
| 6,234,314 | B1 | 5/2001 | Qiu et al. | |
| 6,247,596 | B1 | 6/2001 | Muyskens | |
| 6,286,683 | B1 | 9/2001 | Hunt et al. | |
| 6,513,662 | B1 * | 2/2003 | Stebelton | B65D 81/054 206/586 |
| 6,520,336 | B2 | 2/2003 | Baechle | |
| 6,561,357 | B2 | 5/2003 | Renck | |
| 6,578,346 | B1 | 6/2003 | Sowa | |
| 6,595,367 | B2 | 7/2003 | Baechle | |
| 7,014,046 | B2 | 3/2006 | Niu et al. | |
| 7,048,118 | B2 | 5/2006 | Baechle | |
| 7,048,119 | B2 | 5/2006 | Baechle | |
| 7,128,214 | B2 | 10/2006 | Qiu et al. | |

(Continued)

FOREIGN PATENT DOCUMENTS

| | | | |
|---|---|---|---|
| CN | 202089441 | U | 12/2011 |
| EP | 1547760 | A1 | 6/2005 |

*Primary Examiner* — Steven A. Reynolds
(74) *Attorney, Agent, or Firm* — von Briesen & Roper, s.c.

(57) ABSTRACT

A notched corner post for a package for a product having a first wall and a second wall intersecting at a vertical corner, and a top panel extends outward beyond the second wall to define an overhanging lip. The notched corner post may include a first leg extending upward from a post bottom edge to a first post top edge, and a second leg extending upward to a second post top edge that is lower than the first post top edge to define a notch of the notched corner post. When the notched corner post is installed in the package at the vertical corner, the first leg may engage the first wall with the first post top edge at least level the product top surface, and the second leg may engage the second wall with the second post top edge disposed under the lip bottom surface.

20 Claims, 6 Drawing Sheets

(56) References Cited

U.S. PATENT DOCUMENTS

| | | | | |
|---|---|---|---|---|
| 7,625,616 | B2 * | 12/2009 | Van de Camp | B65D 81/054 206/586 |
| 7,841,469 | B2 | 11/2010 | Muyskens | |
| 8,061,521 | B1 | 11/2011 | Lowry et al. | |
| 8,079,476 | B2 | 12/2011 | Simms et al. | |
| 8,297,492 | B2 | 10/2012 | Muyskens | |
| 8,833,573 | B2 * | 9/2014 | Tomaszewski | B65D 19/385 206/509 |
| 9,010,531 | B2 | 4/2015 | Lowry et al. | |
| 10,822,138 | B1 | 11/2020 | Voorhees | |
| 10,858,167 | B2 | 12/2020 | D'Anglade | |
| D908,003 | S * | 1/2021 | Voorhees | D9/456 |
| 10,899,524 | B1 * | 1/2021 | Voorhees | B65D 81/054 |
| 11,104,501 | B1 | 8/2021 | Voorhees | |
| 11,208,253 | B1 | 12/2021 | Parella | |
| 2005/0035257 | A1 * | 2/2005 | Niu | B65D 5/5033 248/345.1 |
| 2005/0092633 | A1 | 5/2005 | Baechle | |
| 2008/0237419 | A1 * | 10/2008 | Baechle | B65D 19/20 248/219.2 |
| 2011/0266177 | A1 * | 11/2011 | Lowry | B65D 19/44 53/399 |
| 2011/0278310 | A1 * | 11/2011 | Muyskens | B65D 5/5033 220/646 |
| 2013/0032506 | A1 | 2/2013 | Grenchus, Jr. et al. | |
| 2016/0031179 | A1 | 2/2016 | Ulrich | |
| 2016/0280444 | A1 | 9/2016 | Grinwald et al. | |
| 2017/0341857 | A1 | 11/2017 | Jian et al. | |
| 2018/0334282 | A1 | 11/2018 | Gu et al. | |
| 2019/0106260 | A1 | 4/2019 | Ayala | |
| 2020/0180839 | A1 | 6/2020 | Lambert et al. | |
| 2021/0086974 | A1 | 3/2021 | Nugent | |
| 2021/0171264 | A1 | 6/2021 | Jette et al. | |

* cited by examiner

NOTCHED CORNER POST FOR APPLIANCE PACKAGING

TECHNICAL FIELD

The present disclosure relates generally to packaging systems and, more particularly, to corner posts providing vertical stacking strength for packages for appliances and other large products wherein notches are formed in legs of the corner posts to accommodate top or bottom edges that extend outward beyond a side of the product.

BACKGROUND

Articles such as large household appliances (washers, dryers, ranges, etc.) and other large, generally cubic products are often packaged and shipped in packaging units in which the articles rest on transport bases such as pallets and are enclosed by boxes or cartons in which vertical support posts are inserted between the articles and the cartons. The support posts are generally located adjacent the four interior corners of the cartons (and thus are often referred to as corner posts) and typically extend from the transport bases to the tops of the cartons. Each corner post typically has two legs oriented approximately perpendicular to each other. With this configuration, the corner posts nest in the corners of the carton and wrap around the edges of the article. The corner posts not only protect the article from lateral impact forces but also provide axial or vertical stacking strength to the carton. The forces applied to stacked packaging units can be substantial. For example, the force applied to the bottom unit in a stack of six 240 pound units is approximately 1200 pounds of force. Loads placed on top of the packaging unit are borne primarily by the support posts and not by the packaged article.

Generally, the corner posts are cut to a length that is approximately equal to or slightly longer than the height of the packaged article. Where the sides of the article define planar surfaces, the corner posts wrap around the corners with interior surfaces of the legs facing and abutting corresponding surfaces of the article. Sides of the carton, bands or plastic wrap around the article and the corner posts may maintain the surface-to-surface contact and prevent the legs of the corner posts from buckling outward when vertical forces are loaded onto the carton.

In some articles, the sides may not define perfectly planar surfaces, such as when top or bottom walls of the article extend outward beyond the surfaces of the side walls. For example, a dishwasher or washing machine may have a rear edge of a top wall that extends outward past the rear wall to create an overhang covering water hoses couplings, air ducts, power cords or other features passing through the rear wall to the exterior of the article. For such articles, the corner posts may wrap around the corners of the article with surface-to-surface contact of both legs only in the proximity of the extended upper edge. The remainder of the leg of the corner post facing the rear wall and at least a portion of the leg facing the corresponding side wall are out of contact with walls of the article, thereby leaving the corner posts susceptible to buckling inward when subjected to vertical loading.

SUMMARY OF THE DISCLOSURE

In one aspect of the present disclosure, a notched corner post for a package for a product is disclosed. The package may include a base tray having a bottom panel and a top cap having a package top panel. The product may include a first wall extending upward from a product bottom end to a product top surface of a product top panel and a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface. The notched corner post may include a first leg including a first portion of a post inner wall that extends upward from a post bottom end to a first post top edge, and a second leg including a second portion of the post inner wall that extends upward from the post bottom end to a second post top edge that is lower than the first post top edge to define a notch of the notched corner post. The notched corner post may be formed from a hollow paper tube formed into a shape of the notched corner post. When the product is placed on the bottom panel of the package and the notched corner post is installed in the base tray at the vertical corner of the product with the post bottom end on the bottom panel, the first portion of the post inner wall may be facing and engaging the first wall of the product and the first post top edge may be level with or above the product top surface, and the second portion of the post inner wall may be facing and engaging the second wall of the product with the second post top edge disposed under the lip bottom surface.

In another aspect of the present disclosure, a package for a product is disclosed. The product may include a first wall extending upward from a product bottom end to a product top surface of a product top panel, a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface. The package may include a base tray that may have a bottom panel and tray side panels hingedly affixed to the bottom panel along its perimeter and extending upwardly therefrom, wherein the bottom panel and the tray side panels may define a base tray corner corresponding to the vertical corner of the product, and a top cap that may have a package top panel and cap side panels hingedly affixed to the package top panel along its perimeter and extending downwardly therefrom, wherein the package top panel and the cap side panels may define a top cap corner corresponding to the vertical corner of the product. The package may further include a notched corner post that may have a first leg including a first portion of a post inner wall that extends upward from a post bottom end to a first post top edge, and a second leg including a second portion of the post inner wall that extends upward from the post bottom end to a second post top edge that is lower than the first post top edge to define a notch of the notched corner post, wherein the notched corner post may be formed from a hollow paper tube formed into a shape of the notched corner post. When the product is placed on the bottom panel of the package with the vertical corner proximate the base tray corner and the notched corner post is installed in the base tray with the post bottom end inserted between the vertical corner and the base tray corner and engaging the bottom panel, the first portion of the post inner wall may be facing and engaging the first wall of the product and the first post top edge is level with or above the product top surface, and the second portion of the post inner wall may be facing and engaging the second wall of the product with the second post top edge disposed under the lip bottom surface. When the top cap is placed over the product and the notched corner post, the first post top edge of the first leg may engage the package top panel.

In a further aspect of the present disclosure, a notched corner post for a package for a product is disclosed. The package may include a base tray having a bottom panel, a top cap having a package top panel. The product may include a first wall extending upward from a product bottom end to a product top surface of a product top panel, a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface. The notched corner post may include an inner wall that extends upward from a post bottom end and has a first inner wall portion corresponding to the first wall of the product and a second inner wall portion corresponding to the second wall of the product, and an outer wall that extends upward from the post bottom end and has a first outer wall portion corresponding to the first inner wall portion to form a first leg of the notched corner post and a second outer wall portion corresponding to the second outer wall portion to form a second leg of the notched corner post, wherein the inner wall and the outer wall define an enclosed area therebetween. The first inner wall portion and the second inner wall portion may extend upward from the post bottom end to a first post top edge, and the second inner wall portion and the second inner wall portion may extend upward from the post bottom end to a second post top edge that is lower than the first post top edge to define a notch of the notched corner post. When the product is placed on the bottom panel of the package and the notched corner post is installed in the base tray at the vertical corner of the product with the post bottom end on the bottom panel, the first inner wall portion may be facing and engaging the first wall of the product and the first post top edge may be level with or above the product top surface, and the second inner wall portion may be facing and engaging the second wall of the product with the second post top edge disposed under the lip bottom surface.

Additional aspects are defined by the claims of this patent.

DETAILED DESCRIPTION

Figure 1:
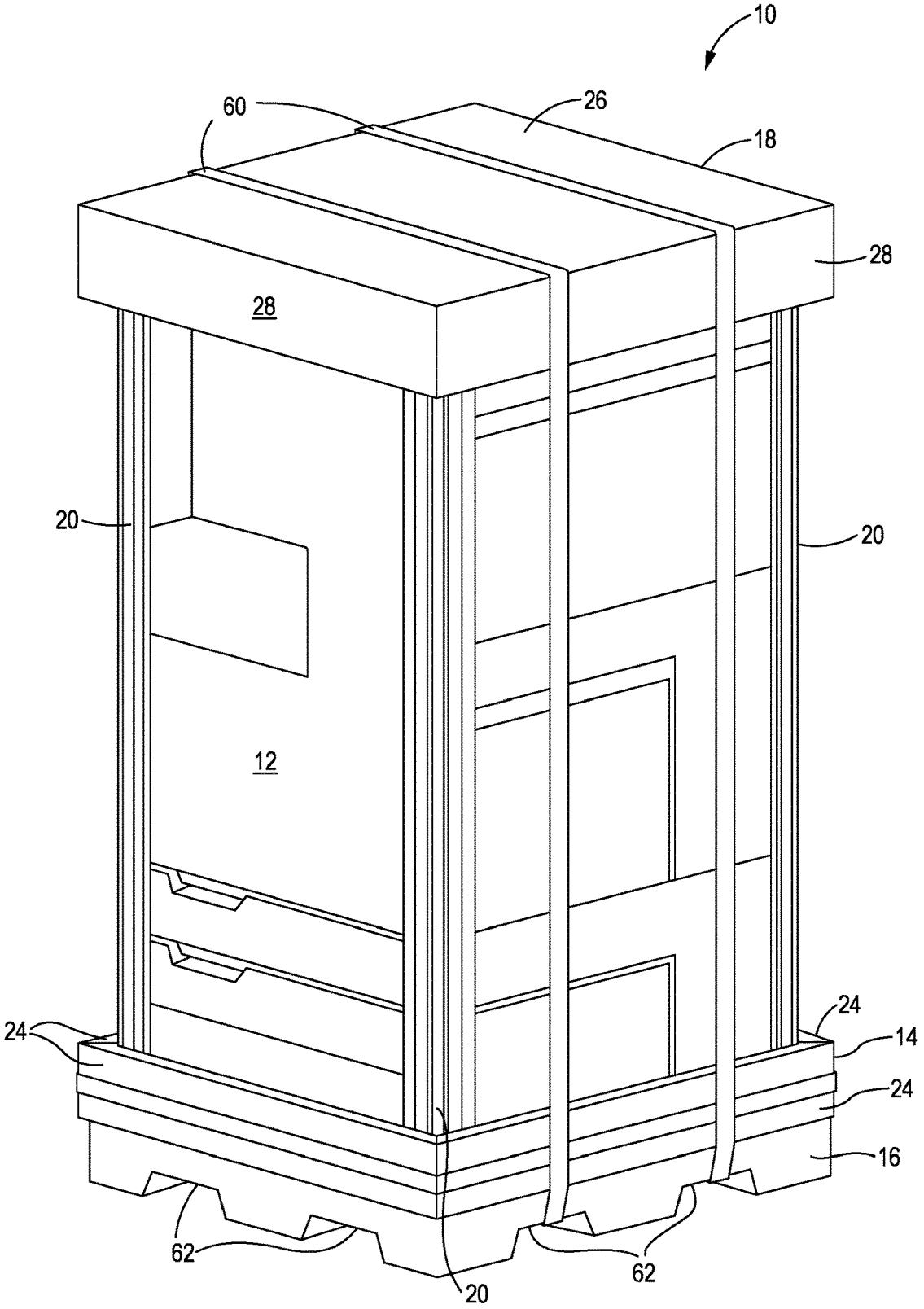
FIG. 1 is a perspective view of a packaging system for a product that may include notch corner posts in accordance with the present disclosure.

FIG. 1 illustrates an exemplary package 10 for a product 12 such as an appliance or other type of heavy article. The package 10 is intended to securely contain the product 12 while using a minimal amount of packaging material that may also be lighter than other packaging materials while being capable of bearing the weight when packages 10 and accompanying products 12 are stacked during storage, shipping and handling. The package 10 may comprise a base tray 14 that may sit on a pallet 16, a top cap 18, and four corner posts 20. The base tray 14, the top cap 18 and the corner posts 20 may be fabricated primarily of paper in the form of corrugated cardboard, for example. The package 10 may include additional components such as foam braces (not shown) as necessary to provide additional structure for the package 10 and protection for the product 12 stored therein. The foam braces may be made from expanded polystyrene foam or other suitable polymer materials. Alternative or additional braces formed from other materials such as paper may also be provided as necessary, and all the braces may be shaped to conform to the shape of the exterior of the product 12 and to fit within the perimeter of the package 10.

The base tray 14 may be formed from a die cut, folded blank and comprises a substantially rectangular bottom panel 22 (FIG. 2) having a perimeter and upwardly extending side panels 24 hingedly affixed to the bottom panel 22 along its perimeter. The bottom panel 22 may define four corners on which the corner posts 20 rest, and the base tray 14 opens upward to receive bottom ends (hidden by side panels 24) of the corner posts 20 and the bottom end of the product 12 so that the bottom panel 22 and the pallet 16 support the weight of the product 12 and axially compressive forces on the corner posts 20 that may be applied when packages 10 are stacked on top of each other. The top cap 18 may be conventional in design including a top panel 26 having a perimeter and side panels 28 extending downward from the perimeter of the top panel 26 so that the top panel 26 opens downward to receive the top ends of the corner posts 20 and the top end of the product 12.

Figure 2:
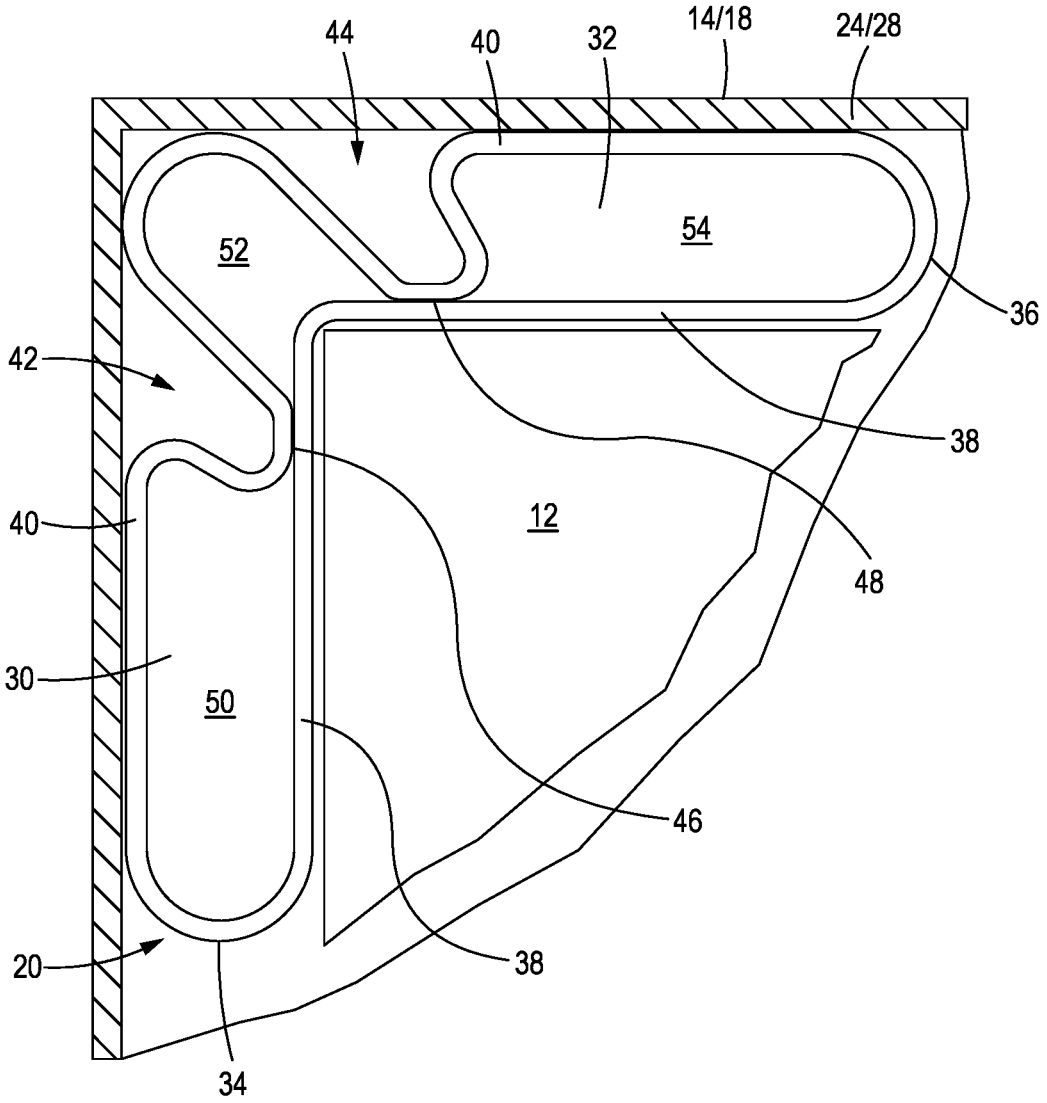
FIG. 2 is a partial cross-sectional top view of a front corner of the packaging system of FIG. 1.

The four corner posts 20 extend vertically from the bottom panel 22 to the top panel 26 and protect the vertical corners of the product 12 from outside abuse while keeping load off the product 12 during stacking. The corner posts 20 may be convolutely wound hollow paper tubes formed into a desired shape, such as those marketed by Sonoco Products Company of Hartsville, S.C., and described in U.S. Pat. Nos. 5,267,651, 6,186,329, 6,234,314, 6,286,683, 7,014,046 and 8,297,492, which are incorporated herein by reference. FIG. 2 illustrates one exemplary configuration of the corner posts 20 that may be notched in accordance with the present disclosure shown in cross-section to illustrate its position relative to either the base tray 14 or the top cap 18, and the product 12. The corner posts 20 are interposed between the product 12 and side panels 24 or 28 in confining engagement therewith.

In the embodiment shown in FIG. 2, the corner post 20 comprises two legs 30, 32 substantially perpendicular to each other which terminate in integrally formed ends 34, 36, respectively, that may be rounded as shown, flat or alternative shapes as may be dictated by a particular implementation or fabrication technique. The legs 30, 32 may be formed by an inner wall 38 (i.e., the wall closest to the product 12) and an outer wall 40 in generally parallel spaced relation to each other. With this configuration, the inner wall 38 of the corner post 20 has a substantially L-shaped cross section. In the illustrated embodiments, the overall corner post 20 has an L-shaped cross-section in a similar manner as the corner posts in the patents listed in the preceding paragraph. However, those skilled in the art will understand that notched corner posts in accordance with the present disclosure may have other profiles that also have an inner wall that engages both surfaces intersecting at a corner of the product as discussed herein. Such alternative profiles are disclosed, for example, in U.S. Pat. Nos. 5,593,039, 6,059,104 and 6,247,596, which are also assigned to Sonoco Product Company and incorporated by reference herein.

Inwardly extending beads or grooves 42, 44 (i.e., grooves extending toward the product 12) are formed in the outer wall 40 along each leg 30, 32 at a point spaced from the ends 34, 36. The grooves 42, 44 may extend the entire vertical length of the outer wall 40. As in conventional corner posts of this type, the grooves 42, 44 may contact the inner wall 38 at contact areas 46, 48, respectively, thus forming multiple enclosed areas 50, 52, 54 within the corner post 20. By forming the grooves 42, 44 and bringing the walls 38, 40 into contact at the contact areas 46, 48, the walls 38, 40 can support each other horizontally, thereby increasing the stability of the corner posts 20 and the package 10, and decreasing the chances that one or both walls 38, 40 will buckle under axial compression forces.

Depending on the requirements for a particular package 10 and product 12, the outer wall grooves 42, 44 may be connected to the inner wall 38 along some or all of the contact areas 46. 48 along the length of the corner post 20. Connecting all or a portion of the opposing walls 38, 40 may increase the axial compression strength of the corner post 20 and the side wall compression stiffness by preventing slipping or moving of one wall relative to the other. The inner and outer walls 38, 40 may be connected by adhesive, stitching, staples or any other suitable means. Varying the amount of connection between the walls 38, 40 may allow the corner post 20 to adequately withstand the axial (vertical) forces and the lateral (horizontal) forces anticipated to be encountered by the package 10 for the product 12 during storage, shipping and handling.

Returning to FIG. 1, bands or straps 60 may be used to secure the top cap 18 on the product 12 and the corner posts 20, and the entire package 10 on the pallet 16. The straps 60 may be threaded through forklift holes 62 on the bottom of the pallet 16. Additional horizontal bands or straps (not shown) may be wrapped around the product 12 and the corner posts 20 to tighten the legs 30, 32 of the corner posts 20 against the sides of walls of the product 12 for further support against buckling under the axial compression forces.

Figure 3:
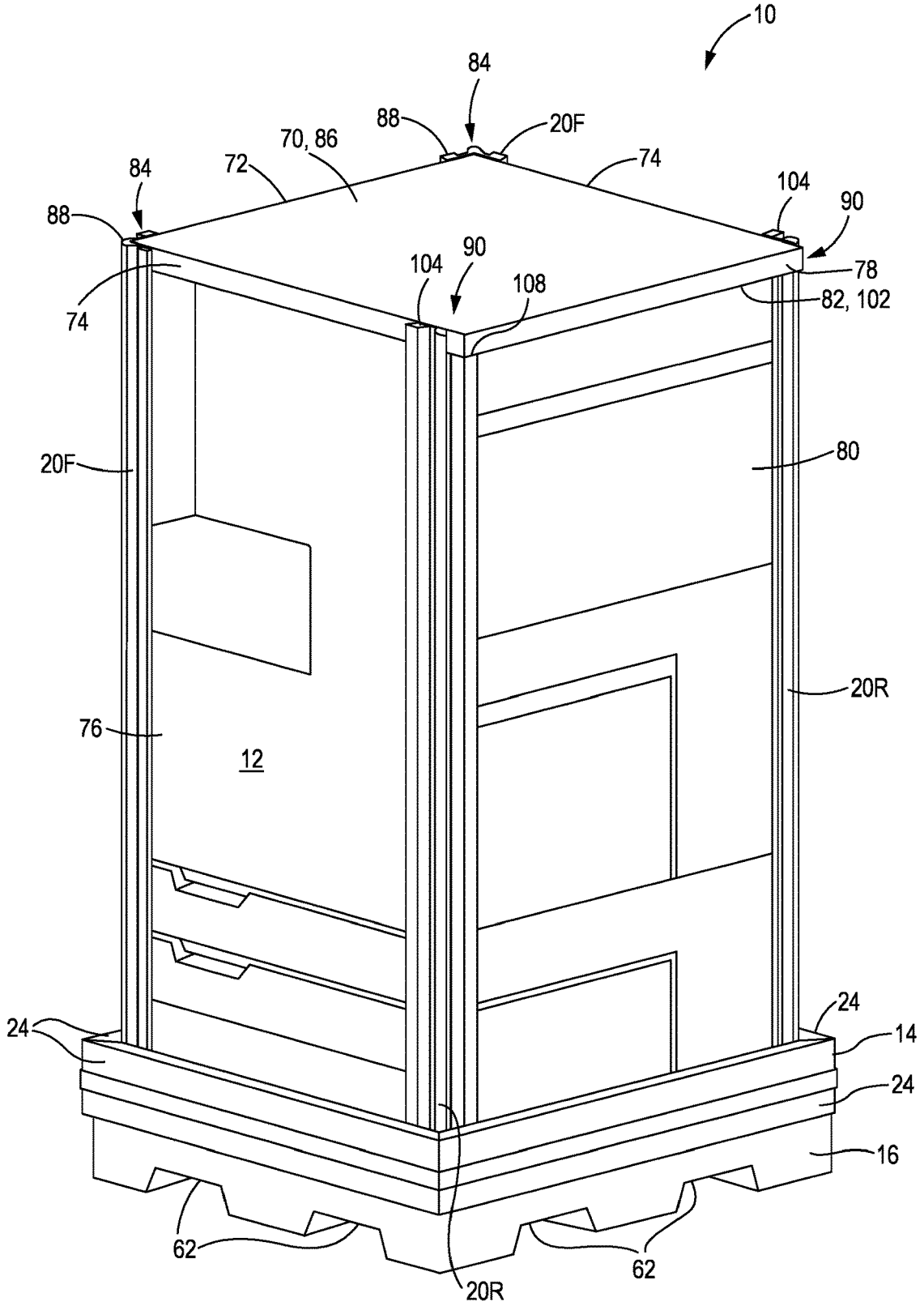
FIG. 3 is a perspective view of the packaging system of FIG. 1 with a top cap removed, the product having an overhanging rear edge and the rear corner posts being notched corner posts in accordance with the present disclosure.

FIG. 3 illustrates the package 10 with the top cap 18 removed to reveal a top panel 70 of the product 12 and the upper ends of the corner posts 20. The product 12 packaged in the package 10 has a configuration that is not conducive for having both legs 30, 32 of previously known corner posts in contact with the intersecting walls at each of the vertical corners of the product 12. As shown, the top panel 70 has a front edge 72 and side edges 74 that are vertically aligned with a corresponding front wall (not visible) and corresponding side walls 76 (only one visible) to define substantially planar vertical surfaces from top to bottom. The top panel 70 also has a rear edge 78 that extends rearward past a rear wall 80 of the product 12 to create an overhanging lip 82 that disrupts the otherwise substantially planar vertical surface as the rear wall 80 extends upward. The overhanging lip 82 may be provided for spacing of the rear wall 80 from an adjacent wall where the product 12 is installed to protect power cords, ducts, hoses, radiator coils and the like passing through the rear wall 80 from being compressed against the adjacent wall, to allow airflow around the product 12, or for other reasons.

The intersection of the top panel 70 with front, side and rear walls has an effect on the implementation of the corner posts 20. At each front corner 84 of the product 12, the planar surfaces of the front wall and a corresponding one of the side walls 76 intersect and extend to a top surface 86 of the top panel 70. Consequently, front corner posts 20F are cut to length perpendicular to the length of the corner posts 20F and parallel to the top surface 86 in the manner currently know in the art so that top edges 88 of the front corner posts 20F are flush with the top surface 86 when the package 10 is assembled around the product 12.

Figure 4:
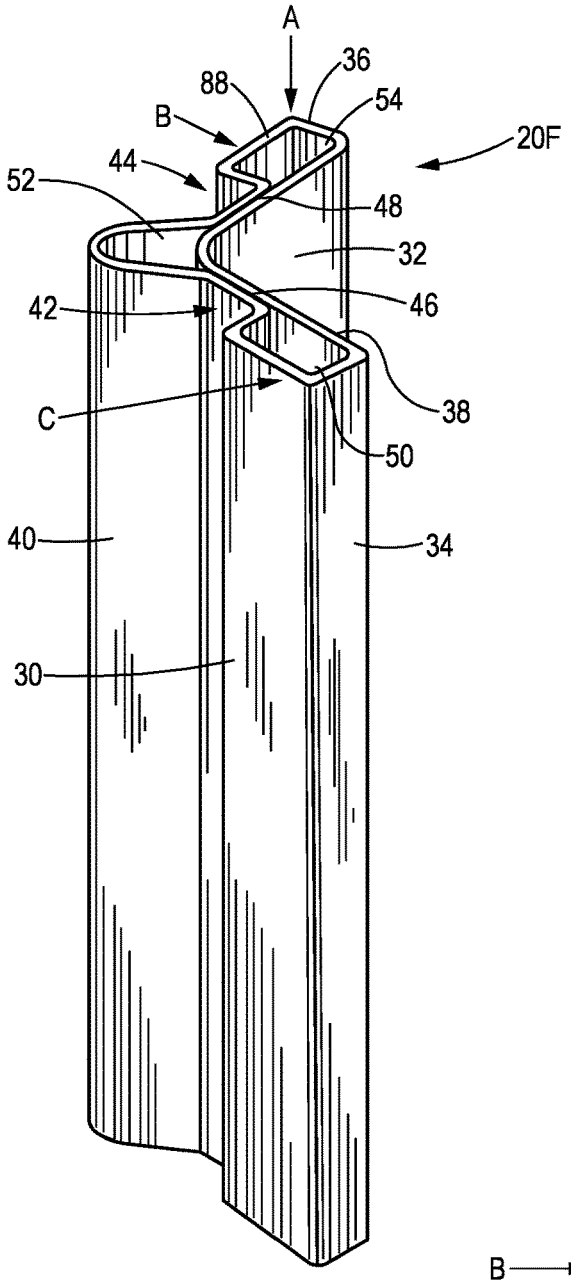
FIG. 4 is a perspective view of a top end of a front corner post of the packaging system of FIGS. 1 and 3 without the product or the top cap of the packaging system.
Figure 5:
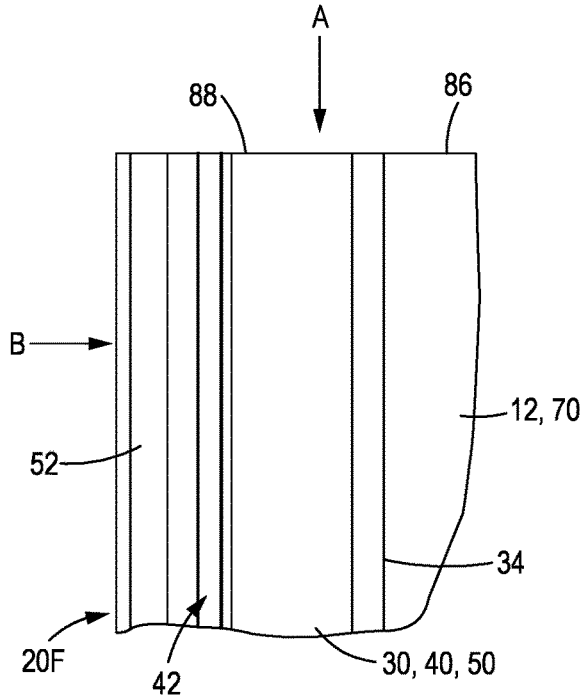
FIG. 5 is a side view of the top end of the front corner post of FIG. 4.

Referring to FIGS. 4 and 5, a top portion of one of the front corner posts 20F is illustrated without and with the product 12, respectively. In the perspective view of FIG. 4, arrow A indicates the direction of the axial compression forces that which might be caused by stacking one package 10 on top of another. Arrows B and C indicate the direction of lateral forces that might be caused by handling the package 10 or by horizontal straps wrapped around the package 10. With the top edge 88 of the front corner posts 20F being flush with the top surface 86 of the product 12 or extending slightly above, the legs 30, 32 of the front corner posts 20F bear all or substantially all of the axial compression forces A. The inner wall 38 along both legs 30, 32 of the front corner posts 20F is in contact with the surfaces of the intersecting front wall and side wall 76 for substantially the entire length of the front corner post 20F to withstand the lateral forces B and C and prevent buckling of the legs 30, 32 due to the axial compression forces A.

Returning to FIG. 3, rear corners 90 of the product 12 do not allow for installation of currently-known corner posts, such as the front corner posts 20F, because the overhanging lip 82 projects beyond the rear wall 80 of the product 12. For a corner post cut in the same manner and length as the front corner posts 20F and wrapping around one of the rear corners 90 of the overhanging lip 82, the inner wall 38 at the leg 30 and most, if not all, of the inner wall 38 at the leg 32 will out of contact with the surfaces of the intersecting walls 76, 80. Without the reinforcing contact between the inner wall 38 and the walls 76, 80, the corner post may be susceptible to buckling at lower axial compression forces A and lateral forces B and C. In some previously-known packaging solutions, additional cushioning structures are installed between the legs 30, 32 and the intersecting walls 76, 80 to reinforce the corner posts. Alternatively, the previously-known corner posts may be cut shorter to fit under and support the overhanging lip 82 such that the top edge 88 engages a bottom surface of the overhanging lip 82. At this length, the inner wall 38 may contact both intersecting walls 76, 80, but only the one of the legs 30, 32 engaging the bottom surface of the overhanging lip 82 will bear the axial compression forces A, thereby reducing the strength of the corner post due to the manner in which it is implemented and possibly requiring the body of the product 12 to bear a greater portion of the axial compression forces A.

As shown in FIG. 3, the support and stability in the package 10 and for the product 12 with the overhanging lip 82 may be increased by providing the rear corner posts 20R as notched corner posts 20R in accordance with the present disclosure. As shown, the legs 30, 32 of the notched corner posts 20R may be cut to different lengths to define notches having complimentary shapes to the overhanging lip 82. With this configuration, both legs 30, 32 of the notched corner post 20R will contribute to bearing the axial compression forces A, and the inner wall 38 at both legs 30, 32 will be in contact with the intersecting walls 76, 80 of the product 12 as discussed further below. It should be noted that while the notched corner posts 20R are illustrated as being rear corner posts for the package 10 and the product 12, notched corner posts 20R in accordance with the present disclosure may be implemented at any corner of a product 12 having an overhanging lip or other similar discontinuity that prevents previously-known corner posts from both legs contact the intersecting walls while at the same bearing axial compression forces A caused by stacking packages 10. Further, while the notched corner post 20R as illustrated and described herein has a notch formed in the leg 30, those skilled is the art will understand that notch may be formed in the leg 32 in a similar manner. Moreover, notches may be formed at the bottom ends of the notched corner posts 20R if necessary.

Figure 6:
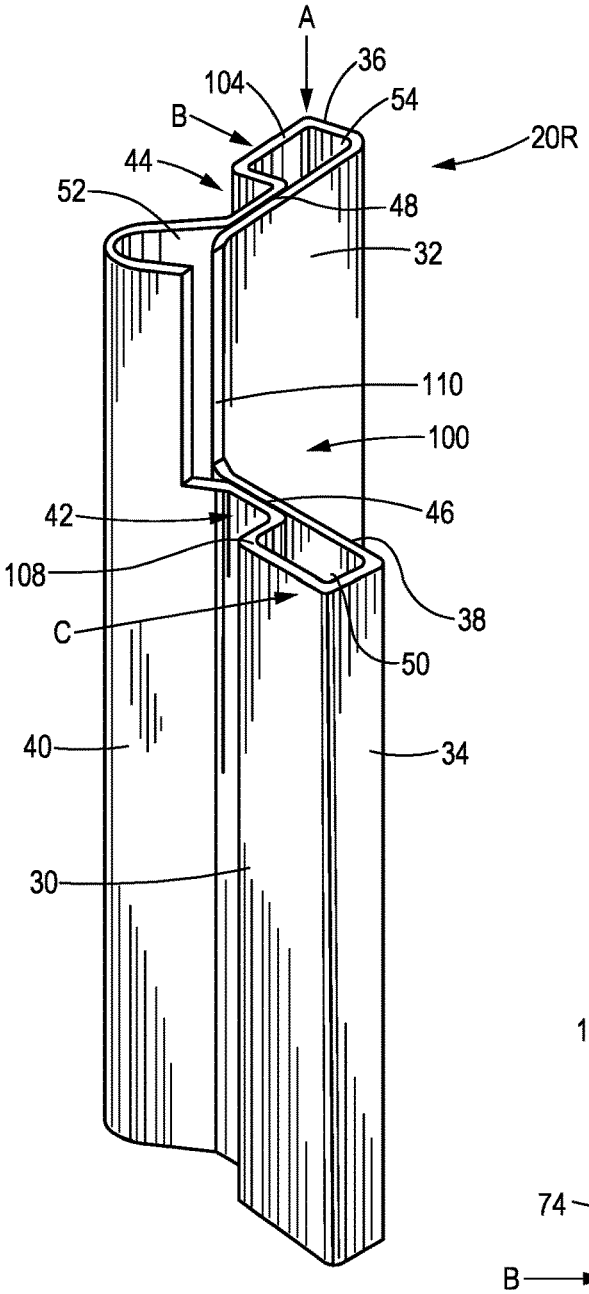
FIG. 6 is a perspective view of a top end of a rear corner post of the packaging system of FIGS. 1 and 3 without the product or the top cap of the packaging system, and with the rear corner post having a notch in accordance with the present disclosure in a first leg.
Figure 7:
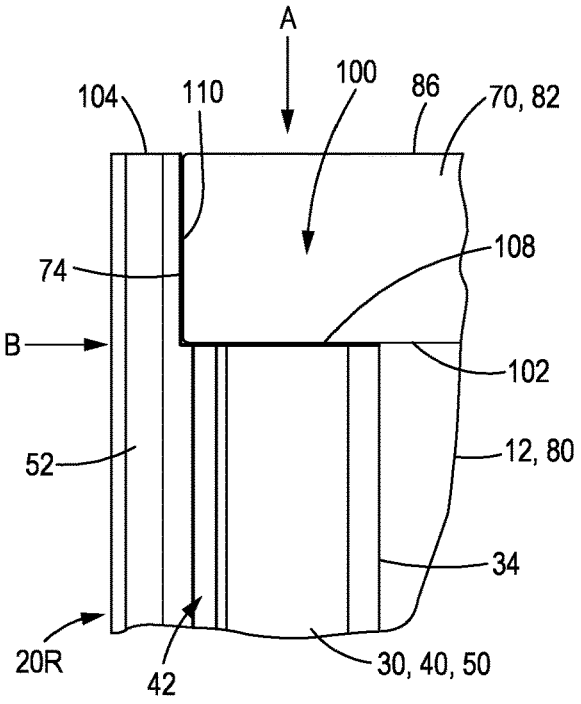
FIG. 7 is a side view of the top end of the rear corner post of FIG. 6 and the overhanging rear edge of the product.

FIG. 6 illustrates a top end of one embodiment of a notched corner post 20R configured for use in the package 10 for the product 12 of FIG. 3. As shown, the top end of the notched corner post 20R is cut or otherwise fabricated to define a notch 100 with a complimentary shape to the overhanging lip 82 (FIG. 7). As shown in FIGS. 3 and 7, the overhanging lip 82 may have a generally horizontal bottom surface 102 that is approximately parallel to the top surface 86 of the top panel 70. As with the front corner posts 20F, the leg 32 of the notched corner post 20R may be cut to length perpendicular to the length of the notched corner posts 20R and parallel to the top surface 86 so that a first top edge 104 of the leg 32 is flush with the top surface 86 when the package 10 is assembled around the product 12. In contrast to the front corner posts 20F, however, the leg 30 of the notched corner post 20R may be cut to length perpendicular to the length of the notched corner posts 20R and parallel to the bottom surface 102, but to a length so that a second top edge 108 of the leg 30 abuts the bottom surface 102 of the overhanging lip 82 when the package 10 is assembled around the product 12. A vertical cut that is perpendicular to the top edges 104, 108 and generally parallel to the corresponding side edge 74 of the top panel 70 may be made through inner wall 38 and the outer wall 40 of the notched corner post 20R. The vertical cut may be performed before or after the cuts for the top edges 104, 108 such that the material of the leg 30 in the area of the notch 100 is removed. The vertical cut defines a vertical edge 110 in the inner wall 38 and the outer wall 40 extending from the first top edge 104 to the second top edge 108. The vertical edge 110 may be substantially flush with the portion of the inner wall 38 at the leg 32 that extends between the top edges 104, 108 so that the inner wall 38 and the vertical edge 110 are substantially co-planar.

FIG. 7 illustrates the notched corner post 20R as installed in the package 10 with the product 12. A corner of the overhanging lip 82 at the intersection of the side edge 74 and the bottom surface 102 is disposed within the notch 100. The second top edge 108 of the leg 30 is disposed under the overhanging lip 82 and abuts the bottom surface 102 of the top panel 70. The first top edge 104 of the notched corner posts 20R may be flush with or extend slightly above the top surface 86 of the top panel 70 with the co-planar vertical edge 110 of the notch 100 and corresponding portion of the inner wall 38 being in contact with the side edge 74 of the top panel 70. The inner wall 38 along both legs 30, 32 of the notched corner post 20R may now be in contact with the surfaces of the intersecting side wall 76 and the rear wall 80 for substantially the entire length of the notched corner post 20R from the bottom surface 102 to the bottom of the product 12. Despite the overhanging lip 82, the legs 30, 32 of the notched corner posts 20R bear the majority of the axial compression forces A. The first top edge 104 of the leg 32 may be in direct contact with the top panel 26 of the package 10, and the overhanging lip 82 is interposed between the top panel 26 and the second top edge 108 so that axial compression forces A are borne by both legs 30, 32. Additionally, the contact between the inner wall 38 and the intersecting walls 76, 80 allow the notched corner post 20R to withstand the lateral forces B and C and prevent buckling of the legs 30, 32 due to the axial compression forces A.

Figure 8:
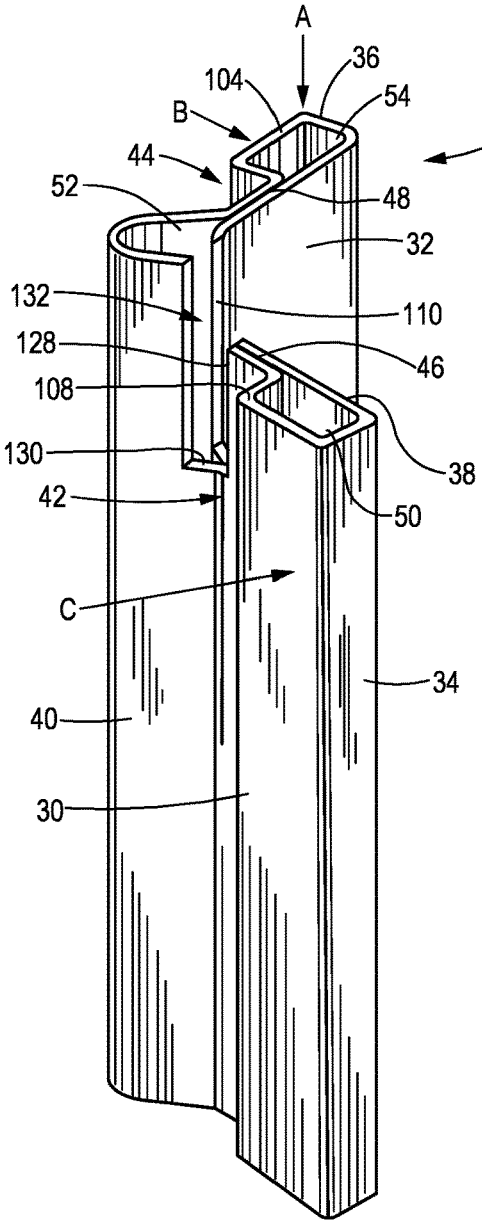
FIG. 8 is a perspective view of a top end of an alternative rear corner post of the packaging system of FIGS. 1 and 3 without the product or the top cap of the packaging system, and with the rear corner post having a notch and a slot in accordance with the present disclosure in a first leg.
Figure 9:
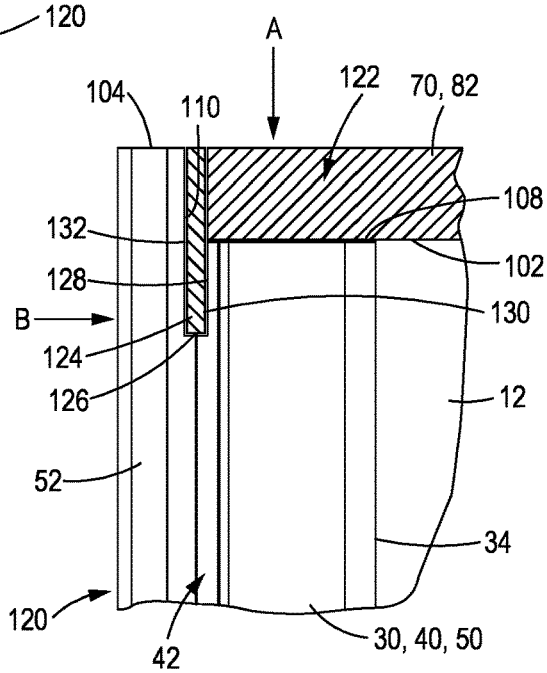
FIG. 9 is a side view of the top end of the rear corner post of FIG. 8 and the overhanging rear edge of the product including a downwardly extending lip.

In the notched corner post 20R of FIGS. 3, 6 and 7, the notch 100 is generally rectangular to be complimentary to the generally perpendicular intersection of the planar side edge 74 and bottom surface 102. Notched corner posts in accordance with the present disclosure may be configured for use in packages 10 for products 12 having overhanging lips 82 with other geometries. For example, FIGS. 8 and 9 illustrate an alternative embodiment of a notched corner post 120 having a notch 122 configured for use with an overhanging lip 82 with a downwardly extending side panel 124 that may be attached to the side edge 74 as shown or integrally formed as part of the top panel 70. In FIGS. 8 and 9, components of the notched corner post 120 corresponding to similar components of the notched corner post 20R are identified by the same reference numerals.

The side panel 124 extends downward below the bottom surface 102 of the top panel 70 and terminates at a side panel bottom edge 126. To accommodate the side panel 124, a second vertical cut may be made in the inner wall 38 and the outer wall 40 to create a second vertical edge 128 that is spaced from the first vertical edge 110 by a horizontal distance that is greater than a thickness of the side panel 124 so that the side panel 124 may be inserted therebetween. The vertical edges 110, 128 may extend downward below the second top edge 108 and terminate at a slot bottom edge 130 to define a side panel slot 132 that is deeper than the distance from the bottom surface 102 to the side panel bottom edge 126. With this configuration, the notch 122 can receive the side panel 124 in the side panel slot 132 without the side panel bottom edge 126 engaging the slot bottom edge 130 while the second top edge 108 of the leg 30 engages the bottom surface 102 of the top panel 70 for transfer of the axial compression forces A to both legs 30, 32 as discussed above. Depending on the size and strength of the side panel 124, the depth of the side panel slot 132 may be approximately equal to the distance from the bottom surface 102 to the side panel bottom edge 126 for engagement between the side panel bottom edge 126 and the slot bottom edge 130 as well as between the bottom surface 102 and the second top edge 108.

Figure 10:
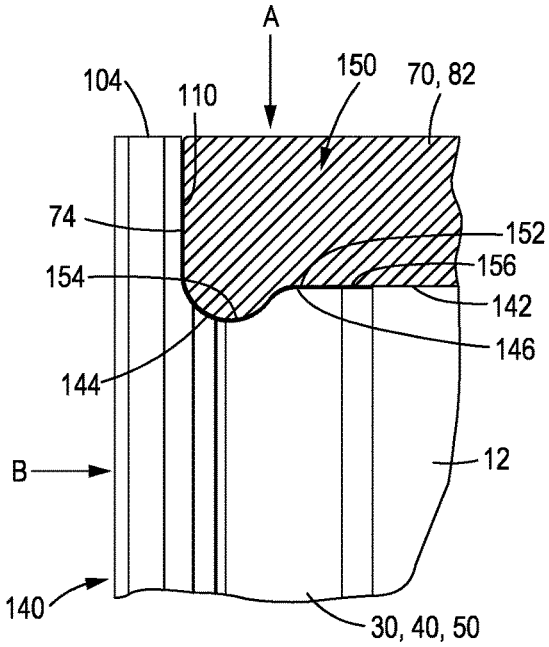
FIG. 10 is a side view of a top end of a further alternative rear corner post of the packaging system of FIGS. 1 and 3 and the overhanging rear edge of the product including a contoured bottom surface.

FIG. 10 illustrates a further alternative embodiment of a notched corner post 140 configured to receive an overhanging lip 82 of a product 12 having a bottom surface 142 with a non-planar profile proximate the rear corner 90 of the product 12. In this configuration, the overhanging lip 82 may be rounded at the outer edges, possibly to facilitate gripping, to eliminate sharp edges, for aesthetic reasons, or the like. As shown, the side edge 74 may transition to a rounded portion 144 of the bottom surface 142 that then transitions into a planar portion 146 of the bottom surface 142. A notch 150 of the notched corner post 140 may have a second top edge 152 formed with a complimentary shape to the bottom surface 142 of the overhanging lip 82. Consequently, the vertical edge 110 may transition to a rounded portion 154 of the second top edge 152 that then transitions into a planar portion 156 of the second top edge 152. The complimentary shape of the second top edge 152 may facilitate contact along substantially the entire interface between the bottom surface 142 of the overhanging lip 82 and the second top edge 152 of the notched corner post 140. However, in some implementations, substantially complete contact may be impractical to achieve based on the geometry of the bottom surface 142. In such cases, the geometry of the second top edge 152 may be optimized to maximize the contact between the bottom surface 142 and the second top edge 152, and the transfer of the axial compression forces A to the legs 30, 32 of the notched corner post 140.

INDUSTRIAL APPLICABILITY

The notched corner posts 20R, 120, 140 in accordance with the present disclosure allow for accommodation of features such as overhanging lips projecting outward from vertical walls for packaging a product while maintaining structural integrity and providing support for loading that may occur during storage, shipping and handling. A notch may be formed in one leg of the notched corner post with a top edge having a complimentary shape to a bottom surface of the outwardly extending feature so that the leg may contact and support the feature while the other leg of the notched corner post extends up to or slightly above a top surface of the product. The accommodation of the outwardly extending feature allows the inner wall of the notched corner post to contact and be supported by the intersecting surfaces at the corner of the product at which the notched corner post is installed. This enables the notched corner post to bear axial compressive forces applied when packages are stacked on top of each other without the legs buckling, and to withstand lateral forces during handling of the package. In this way, the notched corner posts 20R, 120, 140 provide necessary structural support and protection for the product within the package without the necessity of adding material to the corner posts for extra strength or providing additional support components within the package to reinforce and prevent buckling of the corner posts.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A notched corner post for a package for a product, wherein the package includes a base tray having a bottom panel and a top cap having a package top panel, wherein the product includes a first wall extending upward from a product bottom end to a product top surface of a product top panel and a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface, the notched corner post comprising:

a first leg including a first portion of a post inner wall that extends upward from a post bottom end to a first post top edge; and a second leg including a second portion of the post inner wall that extends upward from the post bottom end to a second post top edge that is lower than the first post top edge to define a notch of the notched corner post, wherein the notched corner post is formed from a hollow paper tube formed into a shape of the notched corner post, and wherein, when the product is placed on the bottom panel of the package and the notched corner post is installed in the base tray at the vertical corner of the product with the post bottom end on the bottom panel, the first portion of the post inner wall is facing and engaging the first wall of the product and the first post top edge is level with or above the product top surface, and the second portion of the post inner wall is facing and engaging the second wall of the product with the second post top edge disposed under the lip bottom surface.

2. The notched corner post of claim 1, when the second post top edge engages the lip bottom surface when the notched corner post is installed.

3. The notched corner post of claim 1, wherein the first leg and the second leg define an L-shaped cross-section of the notched corner post.

4. The notched corner post of claim 1, comprising a first vertical edge extending from the first post top edge to the second post top edge, wherein the first vertical edge is facing and engaging the first wall when the notched corner post is installed.

5. The notched corner post of claim 4, wherein the product top panel has a side panel extending downward from the lip bottom surface proximate the vertical corner, wherein the second leg includes a vertical slot defined therein extending downward from the second post top edge proximate the first leg, and wherein the vertical slot receives the side panel when the notched corner post is installed.

6. The notched corner post of claim 5, wherein the first vertical edge extends downward relative to the second post top edge to define a first slot side, a second vertical edge extends downward from the second post top edge to define a second slot side, and a slot bottom edge extends from the first vertical edge to the second vertical edge to define the vertical slot in the second leg.

7. The notched corner post of claim 1, wherein the lip bottom surface defines a non-planar profile proximate the vertical corner, and wherein the second post top edge has a complimentary shape to the non-planar profile of the lip bottom surface so that the second post top edge is in contact with the lip bottom surface along substantially an entire interface between the lip bottom surface and the second post top edge.

8. A package for a product including a first wall extending upward from a product bottom end to a product top surface of a product top panel and a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface, the package comprising:

a base tray having a bottom panel and tray side panels hingedly affixed to the bottom panel along its perimeter and extending upwardly therefrom, wherein the bottom panel and the tray side panels define a base tray corner corresponding to the vertical corner of the product;

a top cap having a package top panel and cap side panels hingedly affixed to the package top panel along its perimeter and extending downwardly therefrom, wherein the package top panel and the cap side panels define a top cap corner corresponding to the vertical corner of the product; and a notched corner post comprising:

a first leg including a first portion of a post inner wall that extends upward from a post bottom end to a first post top edge; and a second leg including a second portion of the post inner wall that extends upward from the post bottom end to a second post top edge that is lower than the first post top edge to define a notch of the notched corner post, wherein the notched corner post is formed from a hollow paper tube formed into a shape of the notched corner post, and wherein, when the product is placed on the bottom panel of the package with the vertical corner proximate the base tray corner and the notched corner post is installed in the base tray with the post bottom end inserted between the vertical corner and the base tray corner and engaging the bottom panel, the first portion of the post inner wall is facing and engaging the first wall of the product and the first post top edge is level with or above the product top surface, and the second portion of the post inner wall is facing and engaging the second wall of the product with the second post top edge disposed under the lip bottom surface, and wherein, when the top cap is placed over the product and the notched corner post, the first post top edge of the first leg engages the package top panel.

9. The package of claim 8, when the second post top edge engages the lip bottom surface when the notched corner post is installed.

10. The package of claim 8, wherein the first leg and the second leg define an L-shaped cross-section of the notched corner post.

11. The package of claim 8, wherein the notched corner post comprises a first vertical edge extending from the first post top edge to the second post top edge, wherein the first vertical edge is facing and engaging the first wall when the notched corner post is installed.

12. The package of claim 11, wherein the product top panel has a side panel extending downward from the lip bottom surface proximate the vertical corner, wherein the second leg includes a vertical slot defined therein extending downward from the second post top edge proximate the first leg, and wherein the vertical slot receives the side panel when the notched corner post is installed.

13. The package of claim 12, wherein the first vertical edge extends downward relative to the second post top edge to define a first slot side, a second vertical edge extends downward from the second post top edge to define a second slot side, and a slot bottom edge extends from the first vertical edge to the second vertical edge to define the vertical slot in the second leg.

14. The package of claim 8, wherein the lip bottom surface defines a non-planar profile proximate the vertical corner, and wherein the second post top edge has a complimentary shape to the non-planar profile of the lip bottom surface so that the second post top edge is in contact with the lip bottom surface along substantially an entire interface between the lip bottom surface and the second post top edge.

15. A notched corner post for a package for a product, wherein the package includes a base tray having a bottom panel and a top cap having a package top panel, wherein the product includes a first wall extending upward from a product bottom end to a product top surface of a product top panel and a second wall extending upward from the product bottom end, wherein the first wall and the second wall intersect at a vertical corner of the product, wherein the product top panel extends outward beyond the second wall to define an overhanging lip having a lip bottom surface that is below the product top surface, and wherein the second wall extends upward to the lip bottom surface, the notched corner post comprising:

an inner wall that extends upward from a post bottom end and has a first inner wall portion corresponding to the first wall of the product and a second inner wall portion corresponding to the second wall of the product; and an outer wall that extends upward from the post bottom end and has a first outer wall portion corresponding to the first inner wall portion to form a first leg of the notched corner post and a second outer wall portion corresponding to the second outer wall portion to form a second leg of the notched corner post, wherein the inner wall and the outer wall define an enclosed area therebetween, wherein the first inner wall portion and the first outer wall portion extend upward from the post bottom end to a first post top edge, and the second inner wall portion and the second outer wall portion extend upward from the post bottom end to a second post top edge that is lower than the first post top edge to define a notch of the notched corner post, and wherein, when the product is placed on the bottom panel of the package and the notched corner post is installed in the base tray at the vertical corner of the product with the post bottom end on the bottom panel, the first inner wall portion is facing and engaging the first wall of the product and the first post top edge is level with or above the product top surface, and the second inner wall portion is facing and engaging the second wall of the product with the second post top edge disposed under the lip bottom surface.

16. The notched corner post of claim 15, wherein the inner wall and the outer wall are integrally formed from a hollow paper tube formed into a shape of the notched corner post.

17. The notched corner post of claim 15, when the second post top edge engages the lip bottom surface when the notched corner post is installed.

18. The notched corner post of claim 15, comprising a first vertical edge of the second inner wall portion and the second outer wall portion extending from the first post top edge to the second post top edge, wherein the first vertical edge is facing and engaging the first wall when the notched corner post is installed.

19. The notched corner post of claim 18, wherein the product top panel has a side panel extending downward from the lip bottom surface proximate the vertical corner, wherein the second inner wall portion and the second outer wall portion include a vertical slot defined therein extending downward from the second post top edge proximate the first leg, and wherein the vertical slot receives the side panel when the notched corner post is installed.

20. The notched corner post of claim 15, wherein the first outer wall portion has a first groove defined therein extending from the post bottom end to the first post top edge and contacting the first inner wall portion at a first contact area, wherein the second outer wall portion has a second groove defined therein extending from the post bottom end to the second post top edge and contacting the second inner wall portion at a second contact area, and wherein the enclosed area comprises:

a first enclosed area defined between the first groove and a first end of the first leg;

a second enclosed area defined between the second groove and a second end of the second leg; and an intermediate enclosed area defined between the first groove and the second groove.

* * * * *